US006241556B1

(12) United States Patent
Chih

(10) Patent No.: US 6,241,556 B1
(45) Date of Patent: Jun. 5, 2001

(54) RETENTION MEMBER FOR CONNECTOR

(75) Inventor: Kuo-Hua Chih, Tau-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/488,950

(22) Filed: Jan. 20, 2000

(30) Foreign Application Priority Data

Dec. 23, 1999 (TW) ..... 088221945

(51) Int. Cl.[7] ..... H01R 13/648
(52) U.S. Cl. ..... 439/607; 439/573
(58) Field of Search ..... 439/607–610, 439/571–573, 79

(56) References Cited

U.S. PATENT DOCUMENTS 5,104,326 * 4/1992 Smith et al. ..... 439/95
5,727,970 * 3/1998 Koguchi et al. ..... 439/607
5,730,609 * 3/1998 Harwath ..... 439/607
5,947,769 * 9/1999 Loenard et al. ..... 439/607
6,050,852 * 4/2000 Wu ..... 439/607
6,066,003 * 5/2000 Chang ..... 439/607
6,077,115 * 6/2000 Yang et al. ..... 439/607

* cited by examiner

*Primary Examiner*—Gary F. Paumen
(74) *Attorney, Agent, or Firm*—Wei Te Chung

(57) ABSTRACT

An electrical connector comprises an elongate insulative housing, a number of terminals received in the housing, and a metallic shield surrounding a front end of the housing. The housing has a body portion consisting of a top wall, a bottom wall, a front wall, a pair of sidewalls and a receiving cavity, and a mating board. A gap separates each sidewall from the front wall and downwardly extends through the housing. Each sidewall defines a channel communicating with the gap, a ditch in an inner side of the channel and a notch in a rear edge of an outer side thereof. The shield comprises a surrounding portion with a pair of feet supporting the shield, a pair of fingers projecting rearwardly from the surrounding portion, and a pair of plates outwardly bending from the fingers. Each finger defines a bending portion, an aperture being defined in the bending portion, and a tab at a rearward side of the bending portion interferentially mating with an interior side of the sidewall. The bending portions extend beyond the gaps and the channels and are then bent outwardly into the notches for securing the shield to the housing.

1 Claim, 5 Drawing Sheets

RETENTION MEMBER FOR CONNECTOR

BACKGROUND OF THE INVENTION

1. Field of the Invention

The present invention relates to a connector, and particularly to a connector with an improved retention member which simplifies manufacture and assembly of the connector.

2. Brief Description of the Prior Art

U.S. Pat No. 5,104,326 issued on Apr. 14, 1992 discloses a connector 6 (see FIG. 5). The connector 6 comprises a longitudinal dielectric housing 60, a metallic shield 70 surrounding a front side 65 of the housing 60, a spacer 80, and a plurality of contacts 90 secured in the housing 60.

The housing 60 is symmetric about a central line in the mating direction and defines a pair of recesses 61 in an upper side thereof, and a pair of notches 62 and four slits 63 in a front end thereof. Two of the slits 63 rearwardly extend from lateral edges of the front end of the housing 60 adjacent end walls 64 and the other two extend rearwardly from a top edge of the front end of the housing 60.

The shield 70 includes a pair of legs 71 bending rearwardly from a top edge thereof, a pair of holes 72 corresponding to the notches 62, and four latches 73 corresponding to the slits 63. Each leg 71 has a foot 711 projecting upwardly from a plate 713 thereof.

The spacer 80 defines a pair of toes 82 extending upwardly from a bottom side thereof and a pair of receiving holes 84 proximate the toes 82.

During assembly, the shield 70 is pushed rearwardly from a front of the housing 60 and then encloses the front end of the housing 60. The pair of legs 71 are respectively received in the recesses 61 of the housing 60. The latches 73 are respectively locked to the slits 63 and the holes 72 are thus aligned with corresponding notches 62. The spacer 80 is then mounted to a top end of the housing 60 so that the feet 711 extend through the receiving holes 82 of the spacer 80. The connector 6 can then be secured to a circuit board (not shown) by the feet 711 and the toes 82 fitting into corresponding holes in the circuit board (not shown).

However, the housing 60 and the shield 70 are complexly configured. The defect in this prior art connector is that there are so many retention members (the legs 71, the feet 711, the latches 73, etc.) that the danger of misfitting pieces within tolerance is aggravated. Moreover, the connector 6 requires a spacer 80 to space and position the contacts 90.

Hence, an improved electrical connector is required to overcome the disadvantages of the prior art.

BRIEF SUMMARY OF THE INVENTION

The object of the present invention is to provide a connector with an improved retention member which simplifies manufacture and assembly of the connector.

To achieve the above-mentioned object, a connector includes an elongate housing, a metallic shield surrounding a front end of the housing, and a plurality of terminals received in the housing.

The housing comprises a body portion, a receiving cavity and a mating board forwardly projecting from a front side of the body portion. The body portion includes a top wall, a bottom wall opposite the top wall, a pair of sidewalls extending between the top wall and the bottom wall, a front wall and a receiving cavity therein. A pair of gaps is defined between the front wall and the sidewalls. Each sidewall defines a channel communicating with the gap, a ditch in an inner side thereof opening to the channel, and a notch at an outer rear end thereof. The bottom wall defines a plurality of cutouts for spacing and securing the terminals.

The shield comprises a surrounding portion, a pair of fingers projecting rearwardly from the surrounding portion, and a plate bending outwardly from a bottom end of the finger. Each finger defines a bending portion at a rear end thereof with an aperture in the bending portion, and a tab at a forward side of the bending portion.

In assembly, the terminals are inserted into the receiving cavity and their lower ends are secured in the bottom wall. The shield is attached to the housing from a front of the housing while the fingers thereof extending beyond the channels. The tab of each finger slides through the gap into the ditch of the sidewall and interferentially fits with an inner side of the sidewall. The bending portion of each finger is then bent outwardly into the notch of the sidewall thereby securing the shield to the housing. The plates of the shield are used to mount the connector to a circuit board.

The connector of the present invention, therefore, is of a greatly simplified design composed with the prior art, having fewer pieces and simpler engaging means. The result should be a connector well fit for mass production at a low cost.

Other objects, advantages and novel features of the invention will become more apparent from the following detailed description of the present embodiment when taken in conjunction with the accompanying drawings.

DETAILED DESCRIPTION OF THE INVENTION

Figure 1:
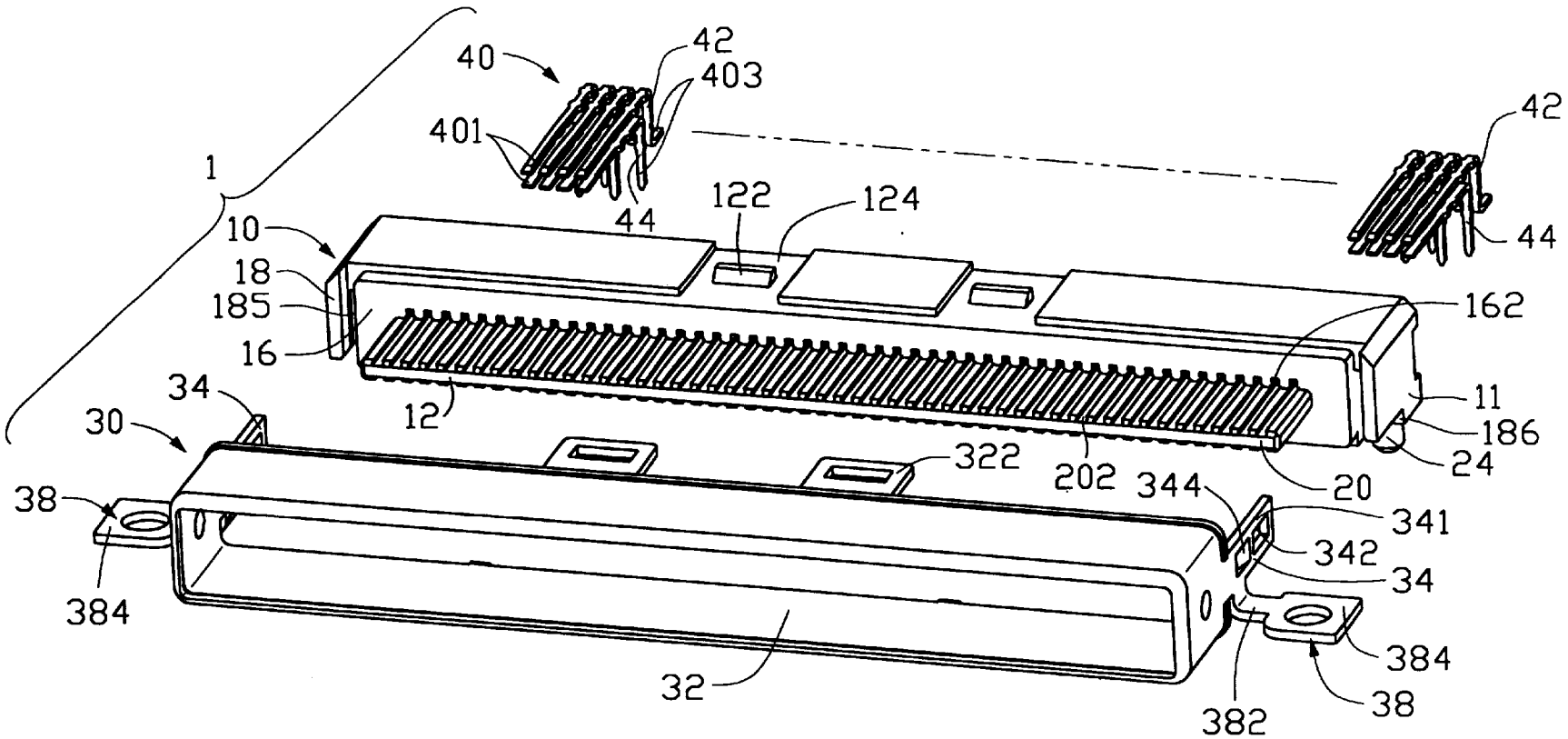
FIG. 1 is an exploded view of an electrical connector of the present invention.
Figure 2:
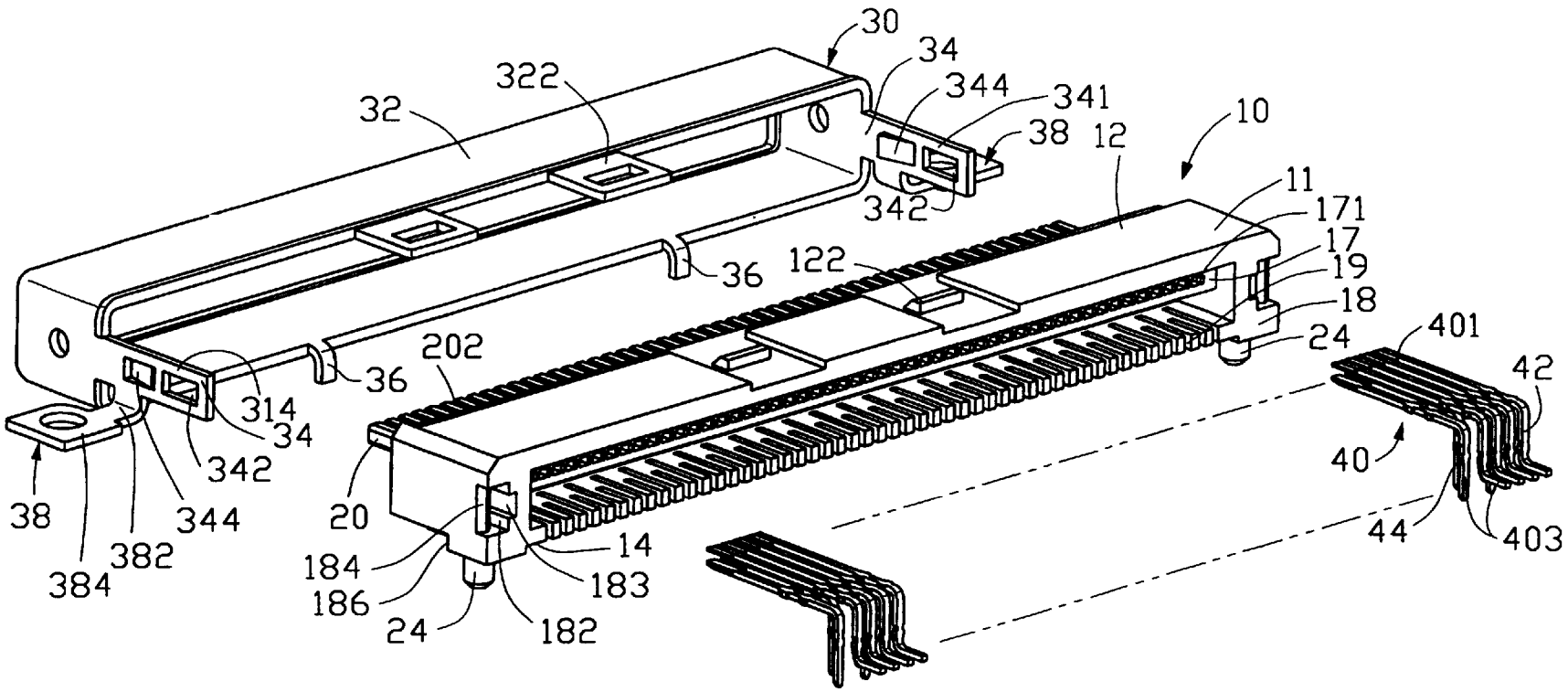
FIG. 2 is another exploded perspective view of the electrical connector of FIG. 1.

Referring to FIGS. 1 and 2, an electrical connector 1 comprises an elongate dielectric housing 10, a conductive shield 30 attached to a front end of the housing 10, and a plurality of terminals 40 received in the housing 10.

The housing 10 includes a body portion 11, a mating board 20 projecting forwardly from the body portion 11, and a pair of posts 24 depending from the body portion 11 for positioning the connector 1. The elongate body portion 11 consists of a top wall 12, a bottom wall 14 opposite the top wall 12, a front wall 16, and a pair of sidewalls 18 extending between the top wall 12 and the bottom wall 14. A receiving cavity 19 is defined by the top wall 12, the bottom wall 14, the front wall 16 and the sidewalls 18. A pair of blocks 122 projects upwardly from respectively depressions 124 in a top surface (not labeled) of the top wall 12. The bottom wall 14 defines a plurality of cutouts 142 extending from a rear side of the bottom wall 14 alternatively in two lengths for spacing the terminals 40. A plurality of holes 162 is arrayed in opposite pairs in the front wall 16 corresponding to the cutouts 142. Each sidewalls 18 defines a channel 182 extending therethrough and a ditch 183 in an inner side thereof communicating with the channel 182. The sidewalls 18 each further have a notch 184 in a rearward outer side thereof. A pair of gaps 185 is provided between lateral sides of the front wall 16 and outer sides of the sidewalls 18 and communicates with the channels 182. Each gap 185 downwardly extends through the housing 10. A forwardly facing side 186 is defined of a rear side of the outer side of each sidewall 18 which projecting downwardly from the bottom wall 14. An insert 17 extends in the receiving cavity 19 and defines a plurality of receiving passages 171 communicating with the holes 162 for receiving the terminals 40.

The mating board 20 extends forwardly from the front wall 16 of the body portion 11 and defines a plurality of passages 202 respectively aligned with the holes 162 and the receiving passages 171 of the insert 17. The passages 202 are arrayed in an upper row and a lower row along a top side and a bottom side of the mating board 20.

The metallic shield 30 includes a surrounding portion 32, a pair of fingers 34 rearwardly projecting from a rear side of the surrounding portion 32, a pair of plates 38 bending outwardly from a bottom edge of each finger 34, and a pair of feet 36 downwardly projecting from lower rear edge of the surrounding portion 32 for supporting the shield 30. The surrounding portion 32 is adapted for enclosing the front wall 16 of the housing 10 to provide EMI (electromagnetic interference) protection. A pair of latches 312 is provided in a top end of the surrounding portion 32 for locking to the blocks 122. Each finger 34 defines a bending portion 341 at a distal end thereof, an aperture 342 being defined in the bending portion 341, and forms a tab 344 inwardly projecting at a forward side of the bending portion 341. The apertures 342 of the bending portions 341 facilitate the bend of the bending portions. The plate 38 has a neck 382 connecting the finger 34 and an engaging plate 384 thereof.

The plurality of terminals 40 includes upper terminals 402 and lower terminals 404. The upper terminals 402 are adapted for surface mounting to a circuit board (not shown) and the lower terminals 404 are suitable for fitting with corresponding through holes in the circuit board (not shown). Each terminal consists of an engaging end 401 and a soldering end 403.

Figure 3:
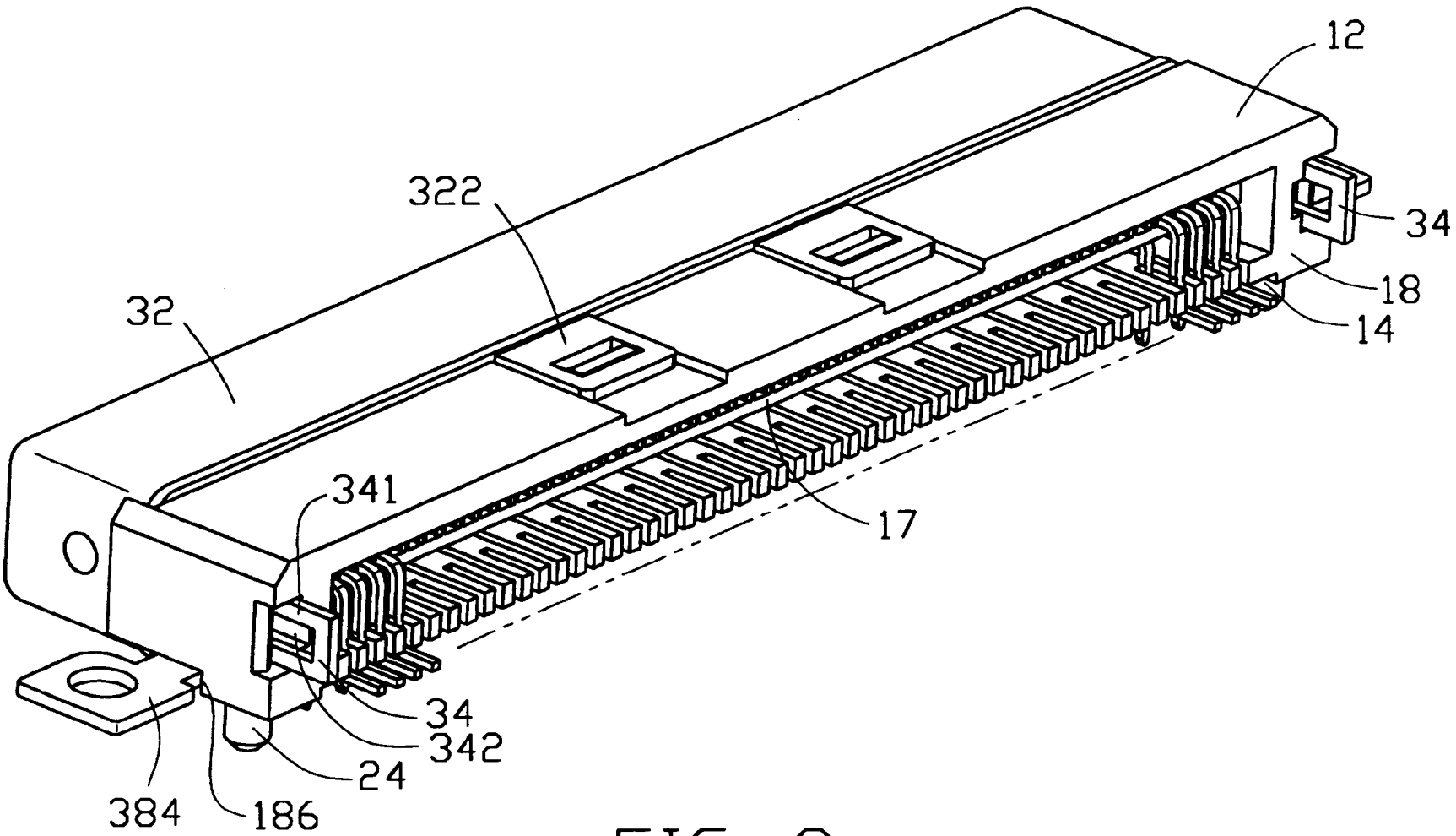
FIG. 3 is a partially assembled view of FIG. 1.
Figure 4:
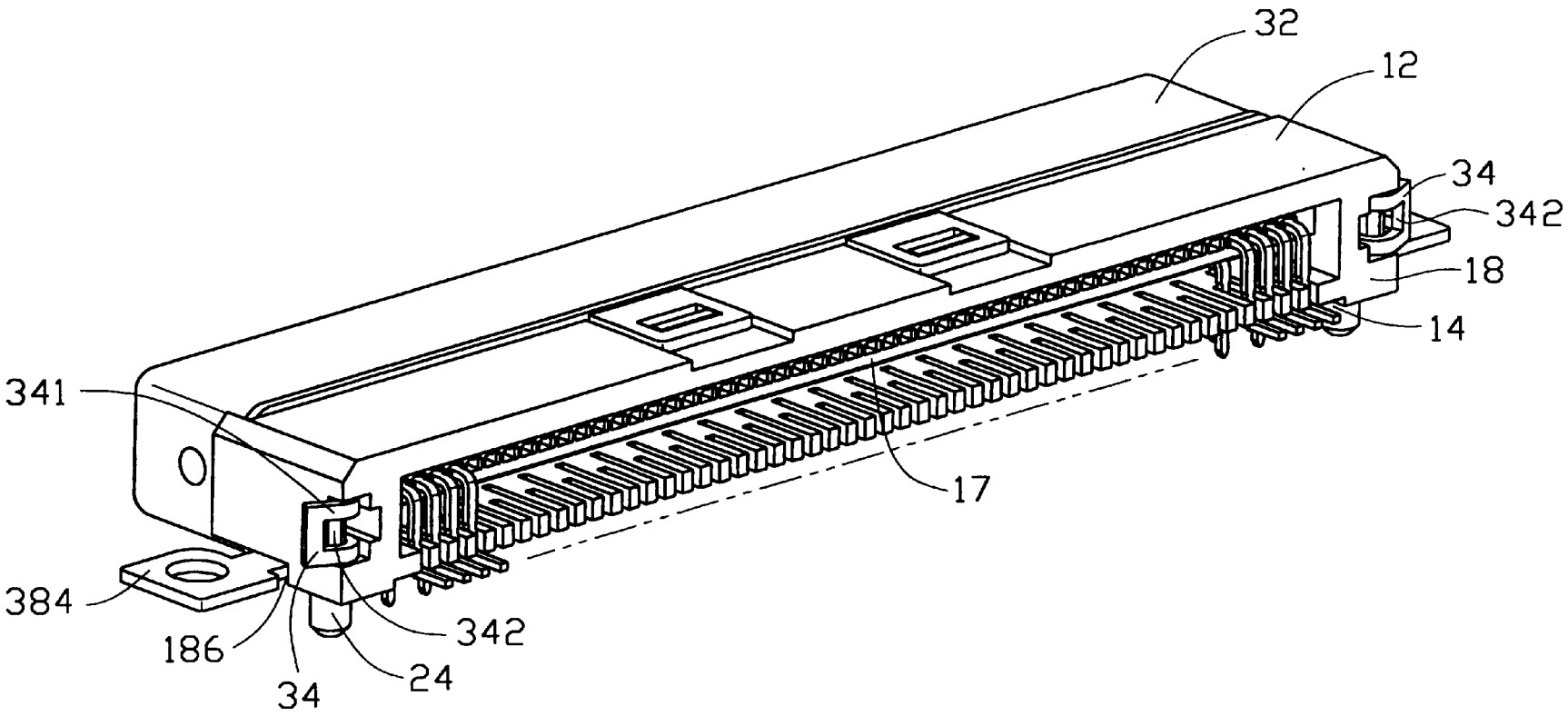
FIG. 4 is an assembled view of FIG. 3.
Figure 5:
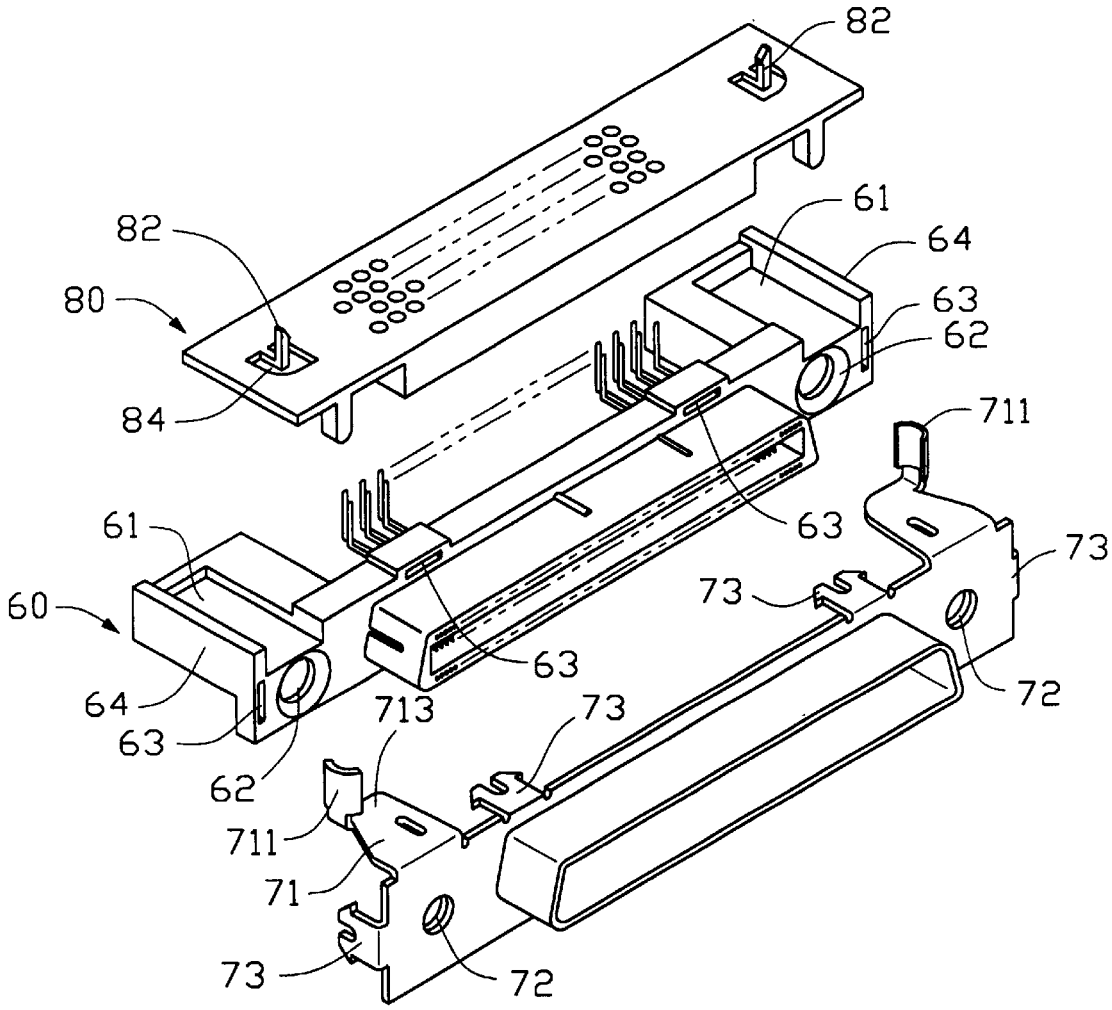
FIG. 5 (PRIOR ART)
FIG. 5 is a partially assembled view of a prior art connector.

In assembly, referring to FIGS. 3 and 4, the terminals 40 are forwardly inserted into the receiving cavity 19 and their engaging ends 401 sequentially extend through the receiving passages 171, the holes 162 and the passages 202. The soldering ends 403 of the terminals 40 are respectively received in the cutouts 142. The shield 30 is then attached to the front wall 16 of the housing 10 from a front of the housing 10 and enclose the mating board 20 while the latches 322 interlock with the blocks 122 and each finger 34 extends through the corresponding gap 185 and channel 182. The neck 382 of each plate 38 simultaneously slides along the gap 185 until a rear edge of the neck 382 fits against the recessed wall 186 of the sidewall 18, the finger 34 being indicated in a complete insertion position. The tab 344 of each finger 34 slides along the ditch 183 thereby interferentially engaging with an inside surface of the sidewall 18. The bending portion 341 of each finger 34 which extends beyond the channel 182 is then bent into the notch 184 for reliably securing the shield 30 to the housing 10. The engaging plates 384 are screwed onto a circuit board (not shown) and the terminals 40 are soldered to the circuit board (not shown) whereby the connector 1 is mounted onto the circuit board (not shown).

In an alternative embodiment, each sidewall 18 of the housing 10 can provide a projection (not shown) in the inside surface of the ditch 183 thereof whereby the corresponding aperture 342 of the finger 34 can interlock with the projection (not shown) for securing the shield 30 to the housing 10. The engaging plate 384 of the plate 38 also can be manufactured for being soldered onto the circuit board (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing including a top wall, a bottom wall opposite the top wall, a front wall connecting the top wall and the bottom wall, a pair of sidewalls extending between the top wall and the bottom wall, and a receiving cavity within the top wall, the bottom wall, the front wall and the sidewalls, an outer side of each sidewall being separated by a gap from the front wall, the gap downwardly extending through the housing, each sidewall defining a channel therethrough in communication with the gap;

a plurality of terminals secured in the receiving cavity; and a metal shield enclosing the front wall and including a surrounding portion and a pair of fingers projecting from the surrounding portion, each finger defining a bending portion at a rear end thereof, the bending portion extending through a corresponding gap and a corresponding channel and being bent to clamp the corresponding outer side;

wherein each sidewall further defines a notch in a rearward edge of the outer side and the bending portion is secured in the notch;

wherein each sidewall further defines a ditch in communication with the channel, and wherein each finger has a tab inwardly projecting from rearwardly of the bending portion into the ditch for inteferentially engaging with an inner side of the sidewall;

wherein each finger further defines an aperture in the bending portion for facilitating the bend of the bending portion;

wherein the housing comprises a body portion and a mating board projecting from the body portion, the body portion including the top wall, the bottom wall, the front wall, the sidewalls and a pair of blocks on a top surface of the body portion, and wherein the shield further has a pair of latches extending from a top rear edge thereof for interlocking with the blocks;

wherein the shield comprises a pair of plates bent outwardly from bottom edges of the fingers, each plate defining a neck connecting the finger and an engaging plate for mounting the connector to a circuit board, and wherein each sidewall further defines a forwardly facing side of a rear side thereof projecting downwardly from the bottom wall, the neck outwardly extending through the gap and pressing against the recessed wall;

wherein the bottom wall defines a plurality of cutouts for spacing and retaining the terminals.

* * * * *